US005806336A

United States Patent [19]

Sunaga et al.

[11] Patent Number: 5,806,336

[45] Date of Patent: Sep. 15, 1998

[54] REFRIGERATION APPARATUS AND LUBRICATING OIL COMPOSITION

[75] Inventors: Takashi Sunaga, Ora-gun; Yoshinobu Obokata, Nitta-gun; Masazo Okajima, Sano; Takeo Komatsubara, Kiryu; Yasuki Takahashi, Sawa-gun, all of Japan

[73] Assignee: Sanyo Electric Co., Ltd., Osaka-fu, Japan

[21] Appl. No.: 564,598

[22] Filed: Nov. 29, 1995

[30] Foreign Application Priority Data

Nov. 29, 1994 [JP] Japan ..... 6-295357

[51] Int. Cl.[6] ..... F04C 18/356; C10M 107/00

[52] U.S. Cl. ..... 62/469; 62/114; 252/68; 417/415; 417/DIG. 1; 418/63; 418/64; 418/179

[58] Field of Search ..... 252/68; 508/485, 508/495; 62/469, 114, 468, 498; 417/415, DIG. 1; 418/63, 64, 179

[56] References Cited

U.S. PATENT DOCUMENTS

| | | | |
|---|---|---|---|
| 5,199,859 | 4/1993 | Kitaichi . | |
| 5,273,410 | 12/1993 | Kitaichi et al. . | |
| 5,423,664 | 6/1995 | Iizuka et al. | 418/179 |
| 5,498,356 | 3/1996 | Kamakura et al. | 252/68 |
| 5,531,574 | 7/1996 | Honma | 417/415 |
| 5,543,371 | 8/1996 | Katayama et al. | 501/97 |
| 5,548,973 | 8/1996 | Komine te al. | 62/469 |
| 5,557,944 | 9/1996 | Hirano et al. | 62/469 |

FOREIGN PATENT DOCUMENTS

| | | |
|---|---|---|
| 0 438 922 A1 | 7/1991 | European Pat. Off. . |
| 0 522 167 A1 | 1/1993 | European Pat. Off. . |
| 0 533 957 A1 | 3/1993 | European Pat. Off. . |
| WO 93/25628 | 12/1993 | WIPO . |

*Primary Examiner*—Alan Diamond
*Attorney, Agent, or Firm*—Darby & Darby

[57] ABSTRACT

There are provided a highly durable and efficient refrigerating apparatus and a lubricating oil composition that uses an HFC type refrigerant and is still free from the problem of thermal hydrolysis of polyol-ester type oil and resulting generation of carboxylic acid and sludge so that the refrigerating apparatus and the lubricating oil composition may be used stably for a prolonged period of time. A lubricating oil composition according to the invention comprises as base oil components a polyol-ester type oil formed by reacting specific polyhydric alcohol with a fatty acid, to which tricresylphosphate and epoxy compound comprising glycidyl ether or carbodiimide are added at respective specific rates. A refrigerating apparatus according to the invention uses such a lubricating oil composition as refrigerator oil and comprises a sealed electric driving compressor whose sliding members are made of a material selected from iron type materials, composite materials of aluminum and carbon, iron type materials surface-treated with chromium nitride and ceramic materials.

8 Claims, 3 Drawing Sheets

REFRIGERATION APPARATUS AND LUBRICATING OIL COMPOSITION

BACKGROUND OF THE INVENTION

1. Field of the Invention

This invention relates to a refrigerating apparatus and a lubricating oil composition and, more particularly, it relates to a refrigerating apparatus comprising a closed electric driving type compressor using an HFC type refrigerant such as 1,1,1,2-tetrafluoroethane (hereinafter referred to as R134a) or a mixture of R134a, difluoromethane (hereinafter referred to as R32) and pentafluoroethane (hereinafter referred to as R125) and refrigerator oil compatible with the refrigerant as well as to a lubricating oil composition that is highly stable and lubricative and can be used as refrigerator oil.

2. Background Art

Dichlorofluoromethane (hereinafter referred to as R12) has been popularly used in compressors for refrigerators, automatic vending machines and showcases. R12 is destructive or potentially destructive to ozone and therefore, if it is released into the atmosphere, it eventually gets to the ozone layer surrounding the earth to fatally destruct it. Because of this problem, the use of R12 and other CFCs is currently rigorously restricted. The real culprit of the ozone layer destruction is the chlorine (Cl) group in the refrigerant compounds. Thus, refrigerants having no chlorine group such as R32, R125, R134a and any mixtures thereof have been proposed as alternatives. R134a is specifically promising as an alternative to R12. (See, inter alia, Japanese Patent Laid-open Publication No. 1-271491.)

Chlorodifluoromethane (hereinafter referred to as R22) that has been used in air conditioners as a refrigerant is also being replaced by HFC type refrigerants because of its adverse effects on the environment particularly in terms of the ozone layer destruction.

However, the above listed HFC type refrigerants including R134a are poorly compatible with refrigerator oil that may be mineral oil or alkylbenzene oil and have been giving rise to the problem of insufficient lubrication of the compressor that is attributable to the poor re-flowability of the refrigerant to the compressor and the phenomenon of pumped up refrigerant that can take place when the compressor is restarted after a pause.

In view of this problem and other problems, the inventors of the present invention have been paying extensive research efforts to produce polyol-ester type oils that can be used as refrigerator oil and are, at the same time, compatible with HFC type refrigerants such as R134a. However, if known polyol-ester type oil is used in a compressor, it is easily heated to rise its temperature by friction between sliding components of the compressor and can be eventually hydrolyzed by heat or decomposed under the effect of iron oxide to produce carboxylic acids and/or metallic soap, which by turn can corrode the sliding components of the compressor. In addition, sludge can be produced also by friction to clog the capillary tube of the compressor. The chemical reactions in the compressor may adversely affect the organic materials of some of the components of the electric motor of the compressor such as magnet wires to severely damage the durability of the compressor.

It is therefore an object of the present invention to provide a highly durable and efficient refrigerating apparatus that uses an HFC type refrigerant such as R134a and polyol-ester type oil compatible with the refrigerant and is still free from the problem of thermal hydrolysis by frictional heat generated by sliding components of the compressor of the apparatus, that of generation of carboxylic acid through hydrolysis of the polyol-ester type oil and resultant sludge, that of corrosion of sliding members and a clogged capillary tube and that of adverse effects on the organic materials of some of the components of the electric motor of the compressor such as magnet wires.

Another object of the present invention is to provide a lubricating oil composition that is highly stable and lubricative and can be used as refrigerator oil of an refrigerating apparatus that uses an HFC type refrigerant. With such a lubricating oil composition, the refrigerating apparatus may be operated stably for a prolonged period of time.

SUMMARY OF THE INVENTION

As a result of extensive research efforts on possible combinations of HFC type refrigerants and polyol-ester type oils compatible with HFC type refrigerants for compressors, the inventors of the present invention discovered that polyol-ester type lubricating oil in a compressor that uses it can be hydrolyzed by frictional heat generated by sliding components of the compressor and the produced fatty acids by turn corrode the sliding components and that such thermal hydrolysis of the polyol-ester type oil by frictional heat generated by sliding components of the compressor can be effectively suppressed by using a lubricating oil composition realized by combining a specific polyol-ester type oil and a specific additive and using selected materials for the sliding components of the compressor.

In series of durability tests, sliding components such as vanes and rollers of compressors wore away severely to raise the total acidity number of the polyol-ester type oil contained therein and pits appeared on the surfaces of rollers to accelerate corrosion and wear. It is safe to assume that carboxylic acids were generated through hydrolysis of the polyol-ester type oil used therein caused by frictional heat of sliding components and acted upon iron members to produce metallic soap and sludge as a result of chemical reactions.

According to an aspect of the present invention, there is provided a refrigerating apparatus comprising a compressor sealedly containing an HFC type refrigerant and refrigerator oil compatible with the HFC type refrigerant, a condenser, a pressure reducer and an evaporator sequentially connected by refrigerant feed pipes to establish a refrigerating circuit, wherein said compressor is contained within a hermetically sealed container, characterized in that said refrigerator oil contains as base oil components a polyol-ester type oil formed by reacting a polyhydric alcohol selected from pentaerythritol (PET), trimethylolpropane (TMP) and neopentylglycol (NPG) with a fatty acid, to which a 0.1 to 2.0% by weight of tricresylphosphate (TCP) and a 0.01 to 10% by weight of epoxy compound comprising glycidyl ether or a 0.01 to 10% by weight of carbodiimide are added, and that sliding members of the compressor are made of a material selected from iron type materials, composite materials of aluminum and carbon, iron type materials surface-treated with chromium nitride and ceramic materials.

In a preferred mode of carrying out the invention, said refrigerator oil contains as base oil components a polyol-ester type oil formed by reacting pentaerythritol (PET) with a fatty acid.

In another preferred mode of carrying out the invention, said refrigerator oil contains as base oil components a polyol-ester type oil formed by reacting trimethylolpropane (TMP) with a fatty acid.

In still another preferred mode of carrying out the invention, said refrigerator oil contains as base oil components a polyol-ester type oil formed by reacting neopentylglycol (NPG) with a fatty acid.

In a preferred mode of carrying out the invention, said compressor is a rotary type compressor comprising a roller made of an iron type material and a vane made of a material selected from iron type materials, composite materials of aluminum and carbon and iron type materials surface-treated with chromium nitride.

In another preferred mode of carrying out the invention, said compressor is a reciprocating type compressor comprising piston/cylinder and rotary shaft/bearing combinations made of a material selected from iron type materials, composite materials of aluminum and carbon and iron type materials surface-treated with chromium nitride.

According to another aspect of the invention, there is provided a refrigerating apparatus comprising a compressor sealedly containing an HFC type refrigerant and refrigerator oil compatible with the HFC type refrigerant, a condenser, a pressure reducer and an evaporator sequentially connected by refrigerant feed pipes to establish a refrigerating circuit, wherein said compressor is contained within a hermetically sealed container, characterized in that said refrigerator oil contains as base oil components a polyol-ester type oil formed by reacting trimethylolpropane (TMP) or pentaerythritol (PET) with a fatty acid, to which a 0.1 to 2.0% by weight of tricresylphosphate (TCP), epoxy compound comprising glycidyl ether or carbodiimide are added, and that sliding members of the compressor are made of a material selected from iron type materials, composite materials of aluminum and carbon and iron type materials surface-treated with chromium nitride.

In a preferred mode of carrying out the invention, said compressor is a rotary type compressor comprising a roller made of an iron type material and a vane made of a material selected from composite materials of aluminum and carbon and iron type materials surface-treated with chromium nitride.

In another preferred mode of carrying out the invention, said compressor is a reciprocating type compressor comprising piston/cylinder and rotary shaft/bearing combinations made of a material selected from iron type materials, composite materials of aluminum and carbon and iron type materials surface-treated with chromium nitride.

According to still another aspect of the invention, there is provided a lubricating oil composition comprising as base oil components a polyol-ester type oil formed by reacting a polyhydric alcohol selected from pentaerythritol (PET), trimethylolpropane (TMP) and neopentylglycol (NPG) with a fatty acid having 6 to 10 carbon atoms, to which a 0.1 to 2.0% by weight of tricresylphosphate (TCP) and a 0.01 to 10% by weight of epoxy compound comprising glycidyl ether or a 0.01 to 10% by weight of carbodiimide are added to enhance the stability and lubricity of the composition.

In a preferred mode of carrying out the invention, such a composition as defined above comprises as base oil components a polyol-ester type oil formed by reacting trimethylolpropane (TMP) or pentaerythritol (PET) with a fatty acid having to 6 to 10 carbon atoms, to which a 0.1 to 2.0% by weight of tricresylphosphate (TCP), epoxy compound comprising glycidyl ether or carbodiimide are added to enhance the stability and lubricity of the composition.

In another preferred mode of carrying out the invention, such a composition as defined above is suitably applied to sliding members of a compressor that are made of a material selected from iron type materials, composite materials of aluminum and carbon, iron type materials surface-treated with chromium nitride and ceramic materials.

In still another preferred mode of carrying out the invention, such a composition as defined above is suitably used as refrigerator oil to be sealedly contained in the compressor of a refrigerating apparatus comprising, beside the compressor, a condenser, a pressure reducer and an evaporator sequentially connected by refrigerant feed pipes to establish a refrigerating circuit where said compressor is contained within a hermetically sealed container.

In another preferred mode of carrying out the invention, such a composition as defined above preferably comprises an oxidation preventive agent. Further, a composition as defined above preferably comprises a copper inactivation agent.

A polyol-ester type oil to be used as base oil component for the purpose of the invention is formed by reacting a polyhydric alcohol selected from pentaerythritol (PET), trimethylolpropane (TMP) and neopentylglycol (NPG) with a fatty acid having 6 to 10 carbon atoms, preferably a fatty acid having 7 to 9 carbon atoms, and most preferably a side-chained fatty acid having 7 to 9 carbon atoms. Specific examples include α56 (tradename: available from Japan Energy Co.) that is a polyol-ester type oil having an average molecular weight of 512 and a viscosity of 51.8 (cSt, at 40° C.) and α68 (tradename: available from Japan Energy Co.) that is a polyol-ester type oil having an average molecular weight of 668 and a viscosity of 62.4 (cSt, at 40° C.).

For the purpose of the invention, a 0.1 to 2.0% by weight of tricresylphosphate (TCP) may be added to the polyol-ester type oil. If the rate of addition is lower than the above defined range, the produced composition shows a poor lubricity because phosphoric acid film is not appropriately produced by TCP to degrade the base oil. If, to the contrary, the rate of addition exceeds the above range, TCP can corrode and wear away the components of the compressor to which it is applied and the base oil can be degraded by decomposition products of TCP.

For the purpose of the invention, a 0.01 to 10% by weight of epoxy compound comprising glycidyl ether may be added to the polyol-ester type oil. If the rate of addition is lower than the above defined range, the produced composition shows a poor thermochemical stability because no effect of the epoxy compound is obtained for it. If, to the contrary, the rate of addition exceeds the above range, the epoxy compound can be polymerized to produce sludge that may be deposited as sediment in the composition. Preferably, a 0.1 to 2.0% by weight of epoxy compound comprising glycidyl ether may be added to the polyol-ester type oil for the purpose of the invention.

For the purpose of the invention, a 0.01 to 10% by weight of carbodiimide may be added to the polyol-ester type oil. If the rate of addition is lower than the above defined range, the produced composition shows a poor thermochemical stability because no carbodiimide effect is obtained for it. If, to the contrary, the rate of addition exceeds the above range, carbodiimide can be polymerized to produce sludge that may be deposited as sediment in the composition. Preferably, a 0.1 to 2.0% by weight, more preferably a 0.05 to 0.5% by weight of carbodiimide may be added to the polyol-ester type oil for the purpose of the invention.

For the purpose of the invention, a 0.01 to 1.0% by weight of an oxidation prevention agent may be added to the polyol-ester type oil, and preferably, the added amount thereof is 0.05 to 0.3% by weight. Examples of such an oxidation prevention agent are 2,6-di-t-butyl-paracresol, 2,6-di-t-butyl-phenol, 2,4,6-tri-t-butyl-phenol or the like. The most preferable one is 2,6-di-t-butyl paracresol.

In addition, for the purpose of the invention, a 1 to 100 ppm of a copper inactivation agent may be added to the polyol-ester type oil, and preferably, the added amount thereof is 5 to 50 ppm. Examples of such a copper inactivation agent are benzotriazole type compounds such as 5-methyl-1H-benzotriazole, 1-di-octyl-aminomethylbenzotriazole, or the like.

One or more than one known additives may be added to a lubricating oil composition according to the invention to such an extent that may not depart from the spirit and scope of the present invention.

With a refrigerating apparatus according to the invention having a configuration as described above and using as refrigerator oil a polyol-ester type oil compatible with an HFC type refrigerant such as R134a, any possible generation of carboxylic acids through hydrolysis of the polyol-ester oil caused by frictional heat of sliding components and resultant accumulation of sludge can be effectively suppressed to make the apparatus operate efficiently and stably for a prolonged period of time as it is free from troubles such as corroded sliding members, a clogged capillary tube due to sedimentary sludge and adversely affected organic materials such as those of the magnet wires of the electric motor of the compressor.

Since a lubricating oil composition according to the invention is highly stable and lubricating, it can find a variety of applications as lubricant.

The present invention essentially consists in the combined use a lubricating oil composition and materials specifically suited for the sliding members of a compressor in order to suppress any possible hydrolysis and pyrolysis of the polyol-ester type oil contained in the composition caused by frictional heat of the sliding members. Thus, a lubricating oil composition according to the invention is substantially free from carboxylic acids and sludge of such acids that may be produced through pyrolysis and hydrolysis of the polyol-ester type oil it contains.

Again, by using a lubricating oil composition according to the invention as refrigerator oil in combination with an HFC type refrigerant in an refrigerating apparatus, the apparatus is made substantially free from troubles such as corroded sliding members, a clogged capillary tube due to sedimentary sludge and adversely affected organic materials such as those of the magnet wires of the electric motor of the compressor of the apparatus so that the apparatus may operate stably and enjoy a prolonged service life.

DETAILED DESCRIPTION OF THE PREFERRED EMBODIMENTS

Now, the present invention will be described in greater detail by referring to the accompanying drawings or FIGS. 1 through 6.

Figure 1:
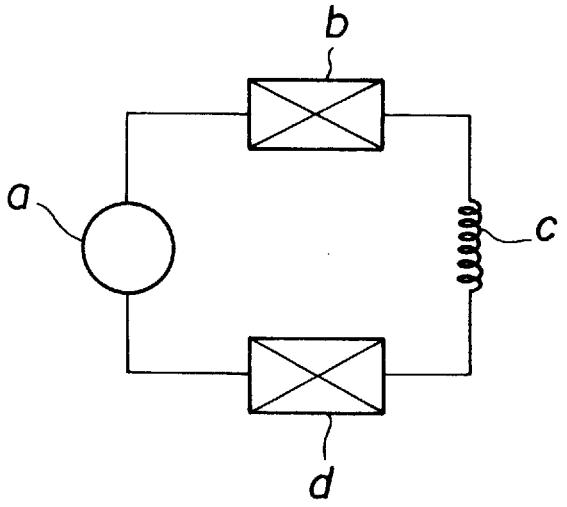
FIG. 1 is a schematic diagram of the refrigerating circuit of a refrigerating apparatus according to the invention.

FIG. 1 is a schematic diagram of the refrigerating circuit of a refrigerating apparatus according to the invention and comprising a closed electric driving type compressor a for compressing an evaporated HFC type refrigerant and discharging it into a condenser b, the condenser b for liquefying the refrigerant, a capillary tube c for reducing the pressure of the refrigerant and an evaporator d for evaporating the liquefied refrigerant, said compressor, condenser, capillary tube and evaporator being sequentially arranged and connected by refrigerant feed pipes to form a closed circuit.

For the purpose of the invention, any compressor such as a rotary compressor, a reciprocating compressor, a vibration compressor, a multi-vane rotary compressor or a scroll compressor may appropriately be used as the compressor a. Simply for the sake of convenience, the present invention will be described hereinafter in terms of a rotary compressor and a reciprocating compressor illustrated respectively in FIGS. 2 and 3 and in FIG. 4.

Figure 2:
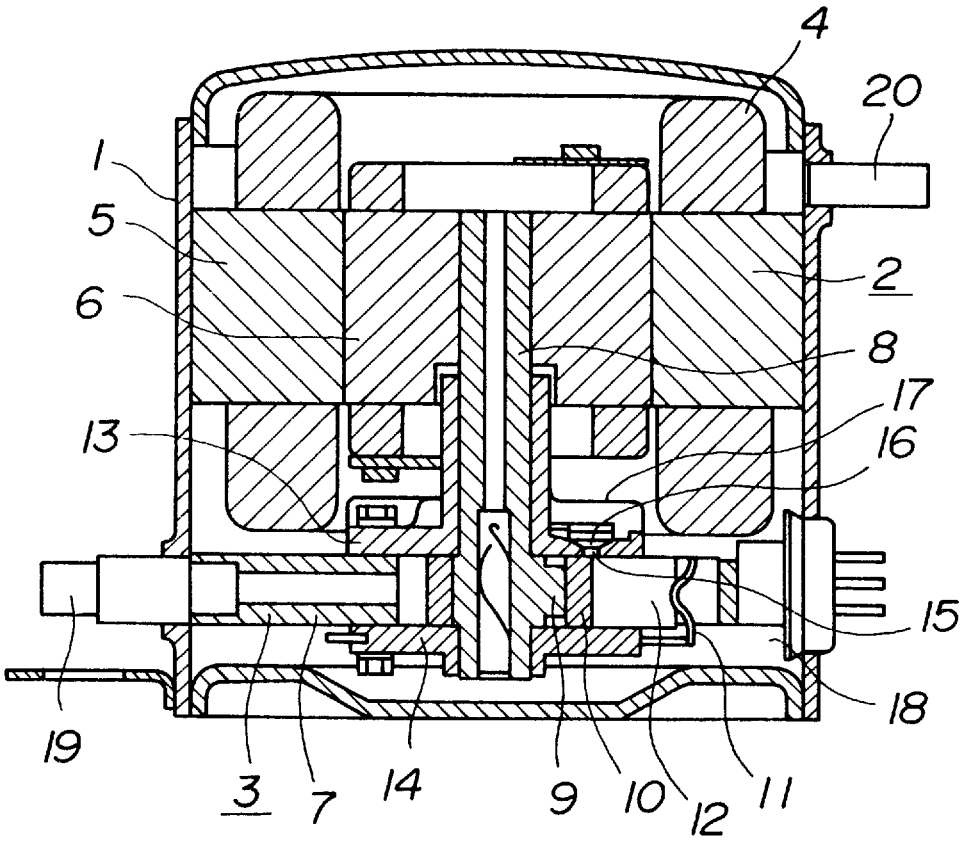
FIG. 2 is a schematic longitudinal cross sectional view of a rotary type compressor that can be used for the purpose of the invention.
Figure 3:
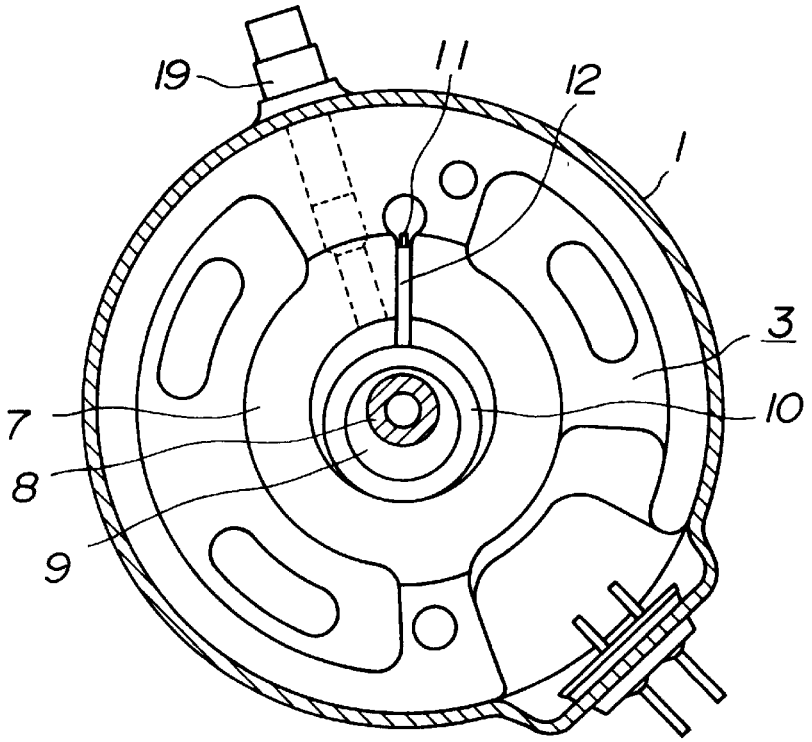
FIG. 3 is a schematic transversal cross sectional view of the rotary type compressor of FIG. 2.

FIG. 2 is a schematic longitudinal cross sectional view of a rotary type compressor that can be used for the purpose of the invention. FIG. 3 is a schematic transversal cross sectional view of the rotary type compressor of FIG. 2. Referring to FIGS. 2 and 3, there are shown a hermetically sealed container 1 containing an electric driving unit 2 and a rotary compressing unit 3 driven by the electric driving unit 2 in upper and lower areas of the container respectively. The electric driving unit 2 comprises a stator 5 provided with a winding wire 4 insulated by an organic material and a rotor 6 arranged within the stator 5. The rotary compressing unit 3 comprises a cylinder 7, a rotary shaft 8 having an eccentric portion 9, a roller 10 designed to be rotated along the inner wall surface of the cylinder 7 by the eccentric portion 9, a vane 12 pushed by a spring 11 so as to divide the inside of the cylinder 7 into a suction side and a discharge side, and upper and lower bearings 13 and 14 for sealing the openings of the cylinder 7 and carrying the rotary shaft 8.

The upper bearing 13 is provided with a discharge port 15 to communicate with the discharge side of the cylinder 7. The upper bearing 13 is further provided with a discharge valve 16 for opening and closing the discharge port 15 and a discharge muffler 17 for covering the discharge valve 16.

The roller 10 is made of an iron type material such as cast iron, whereas the vane 12 is made of a material selected from iron type materials, composite materials of aluminum and carbon and iron type materials such as steel surface-treated with chromium nitride.

An HFC type refrigerant such as a mixture of R134a, R32 and R125 or R32 and R125 is contained in the hermetically sealed container 1 and staying on the bottom thereof. A lubricating oil composition of the invention containing as base oil components a polyol-ester type oil formed by reacting a polyhydric alcohol selected from pentaerythritol (PET), trimethylolpropane (TMP) and neopentylglycol (NPG) with a fatty acid, to which a 0.1 to 2.0% by weight of phosphoric acid triester comprising tricresylphosphate (TCP) and a 0.01 to 10% by weight of epoxy compound comprising glycidyl ether or a 0.01 to 10% by weight of carbodiimide are added is also contained in the hermetically sealed container 1 as refrigerator oil 18 compatible with the refrigerant.

For the purpose of the invention, glycidyl ether may be selected from hexylglycidylether, 2-ethylhexylglycidylether, isooctadecylglycidylether and other similar ethers.

The oil 18 lubricates the sliding surfaces of the sliding members of the rotary compressing unit 3, or the roller 10 and the vane 12.

The refrigerant that flows into the cylinder 7 of the rotary compressing unit 3 to become compressed by coordinated and cooperative motions of the roller 10 and the vane 12 is typically R407C [a mixture refrigerant of R134a, R32 and R125] or R410A [a mixture refrigerant of R32 and R125] that is compatible with the polyol-ester type oil 18.

Reference numeral 19 denotes a suction pipe fitted to the hermetically sealed container 1 to guide the refrigerant to the suction side of the cylinder 7 and reference numeral 20 denotes a discharge pipe fitted to an upper portion of the peripheral wall of the hermetically sealed container 1 to discharge the refrigerant compressed in the rotary compressing unit 3 by means of the electric driving unit 2.

In a rotary type compressor having a configuration as described above and designed to use a lubricating oil composition according to the invention as refrigerator oil, the refrigerant made to flow from the suction pipe 19 into the suction side of the cylinder 7 is compressed by coordinated and cooperative motions of the roller 10 and the vane 12 and discharged through the discharge port 15 and the discharge valve 16, which is opened by then, into the discharge muffler 17. The refrigerant in the discharge muffler 17 is then finally discharged to the outside of the hermetically sealed container 1 through the discharge pipe 20 by means of the electric driving unit 2. Meanwhile, the oil 18 is fed to the sliding surfaces of the sliding members including the roller 10 and the vane 12 of the rotary compressing unit 3 for lubrication. Arrangements are made to prevent the refrigerant compressed in the cylinder 7 from leaking to the low pressure side.

Figure 4:
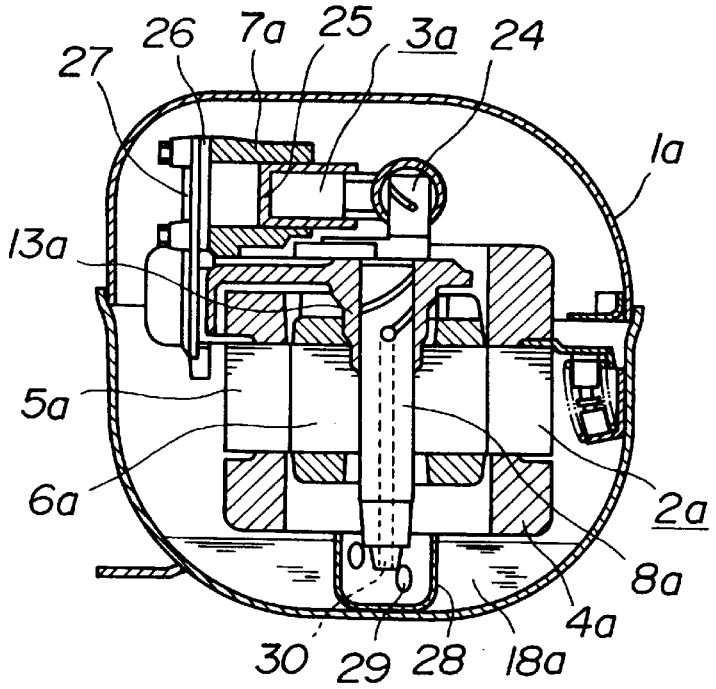
FIG. 4 is a schematic longitudinal cross sectional view of a reciprocating type compressor that can be used for the purpose of the invention.

FIG. 4 is a schematic longitudinal cross sectional view of a reciprocating type compressor that can be used for the purpose of the invention. In FIG. 4, there are shown a hermetically sealed container 1*a* containing an electric driving unit 2*a* and a reciprocating compressing unit 3*a* arranged in lower and upper areas of the container respectively. The electric driving unit 2*a* and the reciprocating compressing unit 3*a* are resiliently arranged on the inner wall of the hermetically sealed container 1*a*.

The electric driving unit 2*a* comprises a stator 5*a* provided with a winding wire 4*a*, a rotor 6*a* arranged within the stator 4*a*, a rotary shaft 8*a* running through the central axis of the rotor 6*a* and carried by a bearing 13*a*.

The reciprocating compressing unit 3*a* comprises a cylinder 7*a*, a piston 25 engaged with crank pin 24 of the rotary shaft 8*a* to reciprocate within the cylinder 7*a*, a valve seat 26 arranged at an end face of the cylinder 7*a* and a cylinder head 27 fitted to the cylinder 7*a* with the valve seat 26 interposed therebetween. A discharge valve (not shown) is fitted to the cylinder head side of the valve seat 26 so as to open and close the discharge port.

In a reciprocating compressor having a configuration as described above and designed to use a lubricating oil composition according to the invention as refrigerator oil, the refrigerant which is an HFC type mixture refrigerant made to flow into the cylinder 7*a* by the reciprocating and sliding motion of the piston 25 is compressed within the cylinder 7*a* and discharged into an external refrigerant circuit (not shown) by opening the discharge valve.

Meanwhile, the oil 18*a* put on the bottom of the hermetically sealed container 1*a* is made to flow into a lubricating oil cup 28 through a hole 29 thereof until the cup is filled with oil. The rotary shaft 8*a* is provided with a lubricating oil passageway 30 running along the central axis thereof and partly put into the center of the opening of the lubricating oil cup 28 so that the oil 18*a* is pumped up into the passageway as the rotary shaft 8*a* is rotated at high speed to produce a vortex of oil there and then circulated through the piston 25/cylinder 7*a* and rotary shaft 8*a*/bearing 13*a* interfaces for lubrication.

[EXAMPLES]

Now, the invention will be further described by way of examples. It should be noted that they are not limiting the scope of the invention by any means.

Figure 5:
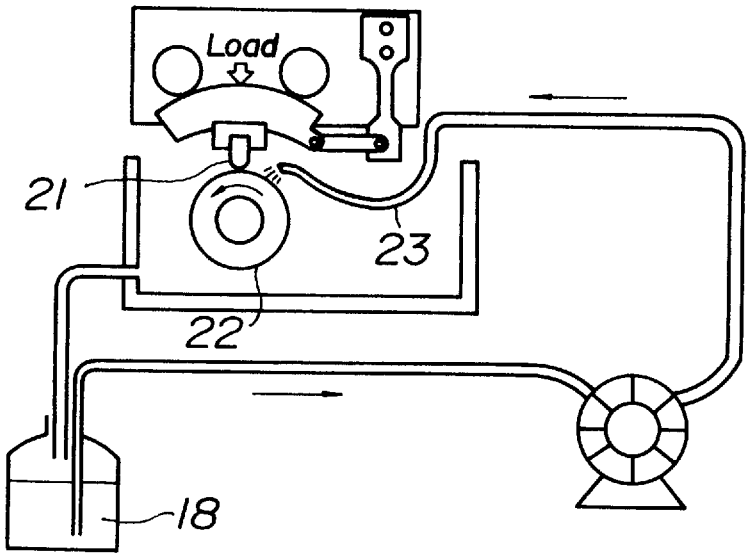
FIG. 5 is a schematic circuit diagram of an Amsler testing machine that can be used for the purpose of the invention.

FIG. 5 is a schematic circuit diagram of an Amsler testing machine used for the purpose of the invention.

Referring to the invention, there are shown a stationary member 21 that corresponds to a vane or cylinder and its front end is rounded to show a radius of curvature of 4.7 mm and subjected to load L of 100 kg, and a rotary member 22 that corresponds to a roller or piston and has a diameter of 45 mm. The rotary member 22 rotates at a rate of 400 rpm for 20 hours while feeding polyol-ester type oil to the pressed interface between itself and the stationary member 21 by way of a feed pipe 23 at a rate of 120 cc per minute.

(Example 1—Wear Tests)

A number of wear tests were conducted with the combinations of components listed below by using an Amsler testing machine as shown in FIG. 5. Table 1 shows the test results.

Vane (stator): spring steel corresponding to JISSUP7 (hereinafter referred as AISI)

composition (% by weight):

C: 0.56–0.64, Si: 0.2–0.35, Mn: 0.75–1.00, P: 0.035 max, S: 0.040 max, Cr: 0.70–0.90, the balance being iron.

Roller (rotor):cast iron (hereinafter referred to as E-3)

composition (% by weight):

T.C (total carbon): 3.2–3.6, Si: 2.2–2.9, Mn: 0.6–1.0, P: 0.18 max, S: 0.08 max, Ni: 0.1–0.2, Cr: 0.20 max, Mo: 0.07–0.2, Ti: 0.25 max, the balance being iron.

Lubricating oil composition (oil):

Three oil compositions having respective viscosities of ISO32, ISO56 and ISO68 were used. More specifically, polyol-ester type oils of combinations of two polyhydric alcohols of pentaerythritol (PET) and trimethylolpropane (TMP) and side-chained fatty acids [a combination of a side-chained fatty acid having 7 carbon atoms and a side-chained fatty acid having 8 carbon atoms (hereinafter referred to as B7B8) and a side-chained fatty acid having 8 carbon atoms and a side-chained fatty acid having 9 carbon atoms (hereinafter referred to as B8B9)] were used as base oils and a 0.1 to 2.0% by weight of tricresylphosphate (TCP), a 0.01 to 10% by weight of epoxy compound (EPOX) [hereinafter generally referred to as additive (EP)] or a 0.05 to 0.5% by weight of carbodiimide [hereinafter generally referred to as additive (CI)] were added thereto. In addition, a 0.05 to 0.3% by weight of 2,6-di-t-butyl-paracresol was added thereto.

TABLE 1

(AISI/E-3)

| Polyol-ester Oils | | | | | Wear of Test Pieces | |
|---|---|---|---|---|---|---|
| Viscosity | Alcohol | Fatty Acid | Additive | Total Acidity | Stator 0.1 × (mm) | Rotor (μm) |
| ISO32 | PET | B7B8 | TCP | 10 | 4 | 5 |
| | PET | B7B8 | EP | 4 | 2 | 1 |
| | PET | B7B8 | CI | 2 | 2 | 1 |
| ISO56 | TMP | B8B9 | TCP | 9 | 4 | 2 |
| | TMP | B8B9 | EP | 8 | 5 | 2 |
| | TMP | B8B9 | CI | 3 | 3 | 2 |
| ISO68 | PET | B8B9 | TCP | 10 | 4 | 2 |
| | PET | B8B9 | EP | 4 | 3 | 1 |
| | PET | B8B9 | CI | 2 | 3 | 1 |

As a result of the tests shown in the Table 1, it was found that the combination of PET and additive (EP) or additive (CI) is effective for ISO32 and ISO68 to improve both the total acidity number (TAN) and the wear quantity of the test pieces.

The reason for this may be that possible pyrolysis and hydrolysis of the polyol-ester type oils by frictional heat at the interface of the rotor 22 and the stator 21 were suppressed by additives (EP) and (CI) to consequently prevent corrosion that can be caused by the fatty acids.

(Example 2—Wear Tests)

A number of wear tests were conducted with the combinations of components listed below by using an Amsler testing machine as shown in FIG. 5. Table 2 shows the test results.

Vane (stator): composite material of aluminum and carbon composition (% by weight):

C: 55, Al: 36, Si: 6, others (such as Mg): 3 roller (rotor): E-3 composition (% by weight):

T.C (total carbon): 3.2–3.6, Si: 2.2–2.9, Mn: 0.6–1.0, P: 0.18 max, S: 0.08 max, Ni: 0.1–0.2, Cr: 0.20 max, Mo: 0.07–0.2, Ti: 0.25 max, the balance being iron.

Lubricating oil composition (oil):

Three oil compositions having respective viscosities of ISO32, ISO56 and ISO068 were used. More specifically, polyol-ester type oils of combinations of two polyhydric alcohols of pentaerythritol (PET) and trimethylolpropane (TMP) and side-chained fatty acids (B7B8 and B8B9) were used as base oils and a 0.01 to 10% by weight of additive (EP) or a 0.01 to 10% by weight of additive (CI) were added thereto. In addition, a 0.05 to 0.3% by weight of 2,6-di-t-butyl-paracresol was added thereto TCP in the column of additives refers to a 0.1 to 2.0% by weight of tricresylphosphate (TCP) added to the base oil.

TABLE 2

(A1 + CARBON/E-3)

| Polyol-ester Oils | | | | | Wear of Test Pieces | |
|---|---|---|---|---|---|---|
| Viscosity | Alcohol | Fatty Acid | Additive | Total Acidity | Stator 0.1 × (mm) | Rotor (μm) |
| ISO32 | PET | B7B8 | TCP | 10 | 5 | 2 |
| | PET | B7B8 | EP | 2 | 5 | 1 |

TABLE 2-continued (A1 + CARBON/E-3)

| Polyol-ester Oils | | | | | Wear of Test Pieces | |
|---|---|---|---|---|---|---|
| Viscosity | Alcohol | Fatty Acid | Additive | Total Acidity | Stator 0.1 × (mm) | Rotor (μm) |
| | PET | B7B8 | CI | 1 | 4 | 1 |
| ISO56 | TMP | B8B9 | TCP | 10 | 22 | 2 |
| | TMP | B8B9 | EP | 2 | 6 | 1 |
| | TMP | B8B9 | CI | 1 | 3 | 1 |
| ISO68 | PET | B8B9 | TCP | 10 | 7 | 2 |
| | PET | B8B9 | EP | 2 | 6 | 1 |
| | PET | B8B9 | CI | 1 | 4 | 1 |

As a result of the tests shown in the Table 2, it was found that the combination of PET and additive (EP) or additive (CI) is effective for ISO32 and ISO68 to improve both the total acidity number (TAN) and the wear quantity of the test pieces of composite vane of aluminum and carbon, whereas the combination of TMP and additive (EP) or additive (CI) is effective for ISO32 to improve both the total acidity number (TAN) and the wear quantity of the test pieces.

The reason for this may be that possible hydrolysis of the polyol-ester type oils was suppressed and hydrolytic production of fatty acid and additives (EP) and (CI), particularly the latter, was stabilized for the combination of a composite vane of aluminum and carbon and an iron type roller.

(Example 3—Wear Tests)

A number of wear tests were conducted with the combinations of components listed below by using an Amsler testing machine as shown in FIG. 5. Table 3 shows the test results.

(Stator)

Vane A: high speed steel for tools

Vane B: composite material obtained by diffusing molten aluminum into carbon (Carbon Al)

composition (% by weight):

C: 55, Al: 36, Si: 6, others (such as Mg): 3

Vane C: fiber reinforced aluminum alloy composition:

SiC whisker: 25–40 (vol %),

Base Matrix: Cu: 4.0–5.0, Si: 16–18, Mg: 0.5–0.65,

Fe: 0.2 or more, Mn: 0.01 or more, Ti: 0.012, Al: the balance (wt %)

Vane D: ceramic material such as zirconia

Vane E: steel surface-treated with chromium nitride (After ion-nitrifying high speed steel JIS SKH51 to form a layer with a thickness of 50 μm, chromium nitride was ion-plated to a thickness of 4 μm.)

(Rotor)

Roller: E-3 composition (% by weight):

T.C (total carbon): 3.2–3.6, Si: 2.2–2.9, Mn: 0.6–1.0, P: 0.18 max, S: 0.08 max, Ni: 0.1–0.2, Cr: 0.20 max, Mo: 0.07–0.2, Ti: 0.25 max, the balance being iron.

Lubricating oil composition (oil):

An oil composition having a viscosity of ISO32 was used. More specifically, a polyol-ester type oil formed by reacting pentaerythritol (PET) with a side-chained fatty acids (B7B8) was used as base oil and a 0.1 to 2.0% by weight of tricresylphosphate (TCP) and a 0.01 to 10% by weight of additive (EP) were added thereto. In addition, a 0.05 to 0.3% by weight of 2,6-di-t-butylparacresol and a 5 to 50 ppm of a benzotriazole type copper inactivation agent was added thereto

TABLE 3

| Combination | | | Wear of Test Pieces | |
|---|---|---|---|---|
| Vane (Stator) | Roller (Rotator) | Total Acidity | Stator 0.1 × (mm) | Rotor (μm) |
| Vane A (High Speed Steel) | Casting | 7 | 7 | 1 |
| Vane B (Carbon Al) | Iron | 2 | 5 | 1 |
| Vane C (Fiber Reinforced Al) | | 3 | 8 | 1 |
| Vane D (Ceramic) | | 1 | 3 | 1 |
| Vane E (Chromium Nitride Treated Steel) | | 2 | 3 | 1 |

As seen from Table 3, the vane materials were ranked in terms of wear and oil degradation in the descending order to read as ceramic, chromium nitride surface-treated steel, aluminum carbon composite material, fiber reinforced aluminum alloy and high speed steel.

The reason for this may be that the less the metal content, the less the wear and the catalytic effect on hydrolysis of polyol-ester type oil.

composition (% by weight):

C: 55, Al: 36, Si: 6, others (such as Mg): 3

Vane C: fiber reinforced aluminum alloy composition:

SiC whisker: 25–40 (vol %),

Base Matrix: Cu: 4.0~5.0, Si: 16~18, Mg: 0.5~0.65, Fe: 0.2 or more, Mn: 0.01 or more, Ti: 0.012, Al: the balance (wt %)

Vane D: ceramic

Vane E: steel surface-treated with chromium nitride (After ion-nitrifying high speed steel JIS SKH51 to for a layer with a thickness of 50 μm, chromium nitride was ion-plated to a thickness of 4 μm.)

Roller: cast ion composition (% by weight):

T.C (total carbon): 3.2~3.6, Si: 2.2–2.9, Mn: 0.6~1.0, P: 0.18 max, S: 0.08 max, Ni: 0.1~0.2, Cr: 0.20 max, Mo: 0.07~0.2, Ti: 0.25 max, the balance being iron.

Lubricating oil composition (oil):

An oil composition having a viscosity of ISO68 was used. More specifically, a polyol-ester type oil formed by reacting pentaerythritol (PET) with a side-chained fatty acids (B8B9) was used as base oil and a 0.1 to 2.0% by weight of tricresylphosphate (TCP) and a 0.01 to 10% by weight of epoxy additive (EP) were added thereto. In addition, a 0.05 to 0.3% by weight of 2,6-di-t-butylparacresol was added thereto

TABLE 4

| Combination | | Wear of Test Pieces | | | | |
|---|---|---|---|---|---|---|
| Vane | Oil/ Refrigerant | Vane | Roller | Rotary Shaft | Bear ing | Total Acidity |
| Vane A (High Speed Steel) | ISO 68POE (PET)/R407C | 1 | 2 | 1 | 1 | 3 |
| Vane B (Carbon Al) | | 1 | 1 | 1 | 1 | 1 |
| Vane C (Fiber Reinforced Al) | | 1 | 2 | 1 | 1 | 1.5 |
| Vane D (Ceramic) | | 1 | 1 | 1 | 1 | 1 |
| Vane E (Chromium Nitride Treated Steel) | | 1 | 1 | 1 | 1 | 1 |
| High Speed Steel | Mineral Oil/R22 | 1 | 1 | 1 | 1 | 1 |

(Example 4—Wear Tests)

Figure 6:
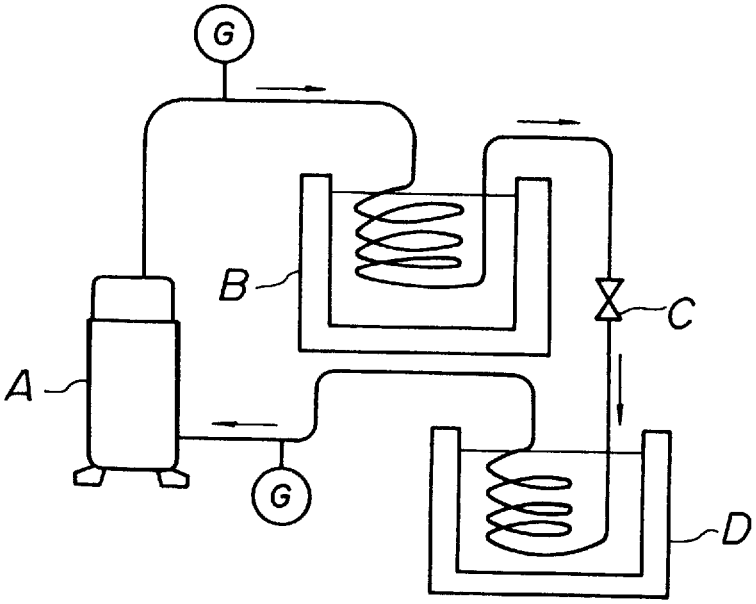
FIG. 6 is a schematic circuit diagram of a bench stand testing machine that can be used for the purpose of the invention.

On the basis of the ranking of Table 3, the following combinations were tested by means of a bench stand testing machine as shown in FIG. 6. Table 4 shows the test results.

In the bench stand testing machine, rotary compressor A, condenser B, expansion valve C and evaporator D were connected with pipes and the following test conditions were used.

Pressure: high pressure: 27–28 kg/cm$^2$.G low pressure: 4.6 kg/cm$^2$.G

Operating Frequency: 100 Hz

Operating Time: 1,000 hrs

Refrigerant: R407C [a mixture of R134a, R32 and R125 with a ratio of 52:23:25]

Temperature of the Casing Top: 95°–100° C.

The following materials were used for the sliding members.

Vane A: high speed steel for tools

Vane B: composite material obtained by diffusing molten aluminum into carbon (Carbon Al)

As shown in Table 4, the materials were marked in terms of wear of components and total acidity number with a 5 rating system, where 5 is no good, 2 and 3 are permissible and 1 is excellent.

It will be seen from Table 4 that, while the vane of fiber reinforced aluminum alloy tended to attack the roller, those of molten aluminum diffused carbon and chromium nitride surface-treated steel and ceramic were excellent in terms of both oil degradation and wear (1 rating). For the purpose of comparison, a conventional combination of refrigerant R-22 and mineral oil was also tested to find that the combinations of the invention performed equally well.

[Advantages of the Invention]

With a combination of a polyol-ester type oil having a specific chemical structure, one or more than one specific additives and a specific material to be used for sliding members of refrigerating apparatus according to the invention, any possible generation of carboxylic acids through hydrolysis of the polyol-ester oil caused by frictional heat of sliding components and resultant accumulation of sludge can be effectively suppressed to make the apparatus operate efficiently and stably for a prolonged period of time even if an HFC type refrigerant such as R134a is used because such a combination is free from troubles such as corroded sliding members of the refrigerating apparatus, a clogged capillary tube of the refrigerating apparatus due to sedimentary sludge and adversely affected organic materials such as those of the magnet wires of the electric motor of the compressor.

Additionally, since a lubricating oil composition according to the invention is highly stable and lubricating, it can find a variety of applications as lubricant.

The present invention essentially consists in the combined use a lubricating oil composition and materials specifically suited for the sliding members of a compressor in order to suppress any possible hydrolysis and pyrolysis of the polyol-ester type oil contained in the composition caused by frictional heat of the sliding members. Thus, a lubricating oil composition according to the invention is substantially free from carboxylic acids and sludge of such acids that may be produced through pyrolysis and hydrolysis of the polyol-ester type oil it contains.

Again, by using a lubricating oil composition according to the invention as refrigerator oil in combination with an HFC type refrigerant in an refrigerating apparatus, the apparatus is made substantially free from troubles such as corroded sliding members, a clogged capillary tube due to sedimentary sludge and adversely affected organic materials such as those of the magnet wires of the electric motor of the compressor of the apparatus so that the apparatus may operate stably and enjoy a prolonged service life.

What is claimed is:

1. A compressor for a refrigerating apparatus, wherein said compressor is sealed and contains an HFC refrigerant and refrigerant oil compatible with the HFC refrigerant, characterized in that:

said refrigerator oil contains as base oil components a polyol-ester oil formed by reacting a fatty acid with pentaerythritol (PET) to which are added 0.1% to 2.0% by weight of tricresylphosphate (TCP), 0.01% to 10% by weight of glycidyl ether, and 0.01% to 10% by weight of a phenol oxidation prevention agent; and said compressor is a rotary compressor comprising a roller made of an iron material and a vane made of an iron material surface-treated with chromium nitride.

2. A compressor for a refrigerating apparatus, wherein said compressor is sealed and contains an HFC refrigerant and refrigerant oil compatible with the HFC refrigerant, characterized in that:

said refrigerant oil contains as base oil components a polyol-ester oil formed by reacting a fatty acid with pentaerythritol (PET), to which are added 0.1% to 2.0% by weight of tricresylphosphate (TCP), 0.01% to 10% by weight of carbodiimide, and 0.01% to 1.0% by weight of a phenol oxidation prevention agent; and said compressor is a rotary compressor comprising a roller made of an iron material and a vane made of an iron material surface-treated with chromium nitride.

3. A compressor according to claim 1 or 2, wherein said phenol oxidation preventive agent is selected from the group consisting of 2,6-di-t-butyl-paracresol, 2,6-di-t-butyl-phenol and 2,4,6-tri-t-butyl-phenol.

4. A compressor according to any of claims 1 or 2, wherein said polyol-ester oil further comprises 1 ppm to 100 ppm of a copper inactivation agent.

5. A compressor according to claim 4, wherein said copper inactivation agent is selected from benzotriazole compounds.

6. A refrigerating apparatus comprising a compressor according to any one of claims 1 or 2, wherein said refrigerating apparatus further comprises a condenser, a pressure reducer and an evaporator sequentially connected by refrigerant feed pipes to establish a refrigerating circuit, said compressor being contained within a hermetically sealed container.

7. A compressor for a refrigerating apparatus, wherein said compressor is sealed and contains an HFC refrigerant and refrigerator oil compatible with the HFC refrigerant, characterized in that:

said refrigerator oil contains as base oil components a polyol-ester oil formed by reacting a fatty acid with a polyhydric alcohol selected from Pentaerythritol (PET), trimethylolpropane (TMP) or neopentylglycol (NPG), to which are added 0.1% to 2.0% by weight of tricresylphosphate (TCP) and 0.01% to 10% by weight of an epoxy compound, wherein the epoxy compound comprises glycidyl ether or 0.01% to 10% by weight of carbodiimide; and wherein said compressor is a reciprocating compressor comprising piston/cylinder, rotary shaft/bearing combinations made of a material selected from composite materials of aluminum and carbon, or iron materials surface-treated with chromium nitride.

8. A compressor according to claim 7 wherein said polyol-ester oil further comprises 0.01% to 1.0% by weight of a phenol oxidation prevention agent.

* * * * *